US007900467B2

(12) United States Patent
Allen

(10) Patent No.: US 7,900,467 B2
(45) Date of Patent: Mar. 8, 2011

(54) COMBINED RECEIVER AND HEAT EXCHANGER FOR A SECONDARY REFRIGERANT

(75) Inventor: Robert B. Allen, Lawrenceville, GA (US)

(73) Assignee: Hussmann Corporation, Bridgeton, MO (US)

( * ) Notice: Subject to any disclaimer, the term of this patent is extended or adjusted under 35 U.S.C. 154(b) by 602 days.

(21) Appl. No.: 11/781,349

(22) Filed: Jul. 23, 2007

(65) Prior Publication Data

US 2009/0025404 A1 Jan. 29, 2009

(51) Int. Cl.
*A47F 3/04* (2006.01)

(52) U.S. Cl. ..... 62/246; 62/332; 62/435; 165/140

(58) Field of Classification Search ..... 62/335, 62/509, 513, 246–256, 332–333, 430–439; 165/140–141

See application file for complete search history.

(56) References Cited

U.S. PATENT DOCUMENTS

| | | | | | |
|---|---|---|---|---|---|
| 1,980,688 | A | * | 11/1934 | Lewis | 62/81 |
| 2,079,687 | A | * | 5/1937 | Fourness | 62/335 |
| 2,434,221 | A | * | 1/1948 | Newton | 62/175 |
| 2,612,357 | A | * | 9/1952 | Parks | 62/390 |
| 2,764,876 | A | * | 10/1956 | Parcaro | 62/324.1 |
| 3,199,304 | A | * | 8/1965 | Zeitz et al. | 62/79 |
| 3,670,522 | A | * | 6/1972 | Bresin | 62/333 |
| 3,675,441 | A | | 7/1972 | Perez | |
| 3,938,349 | A | | 2/1976 | Ueno | |
| 4,236,381 | A | | 12/1980 | Imral et al. | |
| 4,329,855 | A | | 5/1982 | Larsson | |
| 4,537,045 | A | | 8/1985 | Mayer | |
| 4,567,733 | A | * | 2/1986 | Mecozzi | 62/175 |
| 4,597,268 | A | * | 7/1986 | Andersson | 62/93 |
| 4,773,234 | A | | 9/1988 | Kann | |
| 4,787,211 | A | * | 11/1988 | Shaw | 62/117 |
| 5,400,615 | A | * | 3/1995 | Pearson | 62/277 |
| 6,148,634 | A | * | 11/2000 | Sherwood | 62/434 |

FOREIGN PATENT DOCUMENTS

| | | |
|---|---|---|
| EP | 1329675 | 7/2003 |
| EP | 1422487 | 5/2004 |
| JP | 07294031 | 11/1995 |
| JP | 09196480 | 7/1997 |
| JP | 11248294 | 9/1999 |
| JP | 2004069142 | 3/2004 |
| WO | 2004/042291 | 5/2004 |

OTHER PUBLICATIONS

Pearson A B et al: "A Distribution Warehouse With CO2 as Refrigerant." International Congress of Refrigeration Proceedings—Congresinternational du Froid Comptes Rendus, Aug. 17, 2003, pp. 1-6. Verhoef P J: "Opportunities for CO2 in Supermarket Refrigeration." Science et Technique du Froid—Refrigeration Science and Technology, Paris, FR, Aug. 29, 2004, pp. 1-9.

Winandy E et al: "Scroll Compressors For CO2 in Cascade Systems." Science et Technique du Froid—Refrigeration Science and Technology, Paris, FR, Aug. 29, 2004, 8 pages.

Yanagisawa T et al: "Operating Characteristics of Natural Circulating CO2 Secondary Loop Refrigeration System Working With NH3 Primary Loop." Science et Technique du Froid—Refrigeration Science and Technology, Paris, FR, Aug. 29, 2004, 8 pages.

* cited by examiner

*Primary Examiner* — William E Tapolcai
(74) *Attorney, Agent, or Firm* — Michael Best & Friedrich LLP

(57) ABSTRACT

A refrigeration system includes a first circuit configured to circulate a first refrigerant. The first circuit includes an evaporator. The refrigeration system also includes a second circuit configured to circulate a second refrigerant. The second circuit includes a receiver associated with the evaporator such that the second refrigerant within the receiver is in a heat exchange relationship with the first refrigerant within the evaporator.

22 Claims, 2 Drawing Sheets

COMBINED RECEIVER AND HEAT EXCHANGER FOR A SECONDARY REFRIGERANT

BACKGROUND

The present invention relates to a refrigeration system. More particularly, the present invention relates to a refrigeration system having multiple refrigeration circuits.

In some configurations, a liquid recirculation refrigeration system includes a primary refrigeration circuit that circulates a first refrigerant to remove heat from (i.e., cool) a second refrigerant circulating through a secondary refrigeration circuit. Typically, the secondary refrigeration circuit requires a net positive suction head in order for a pump to effectively circulate the second refrigerant. In such a system, a heat exchanger of the primary circuit is provided to cool the second refrigerant. The heat exchanger is typically located above a liquid holding tank or receiver of the secondary circuit to allow a gravity feed and facilitate 100% liquid (i.e., refrigerant) return. However, locating the heat exchanger above the receiver, and the receiver above the pump, creates an overall height which can be objectionable in some circumstances. In addition, the material costs for these types of refrigeration systems can also be expensive in comparison to a traditional vapor compression refrigeration system.

SUMMARY

In one embodiment, the invention provides a refrigeration system including a first circuit configured to circulate a first refrigerant. The first circuit includes an evaporator. The refrigeration system also includes a second circuit configured to circulate a second refrigerant. The second circuit includes a receiver associated with the evaporator such that the second refrigerant within the receiver is in a heat exchange relationship with the first refrigerant within the evaporator.

In another embodiment, the invention provides a method of exchanging heat between a first refrigerant and a second refrigerant. The method includes circulating the first refrigerant through a first circuit having an evaporator, circulating the second refrigerant through a second circuit having a receiver associated with the evaporator, and exchanging heat between the first refrigerant within the evaporator and the second refrigerant within the receiver.

In yet another embodiment, the invention provides a refrigeration system including a first circuit having a first evaporator and a second circuit having a receiver. The refrigeration system also includes a first refrigerant within the first evaporator being in a heat exchange relationship with a second refrigerant within the receiver. The refrigeration system further includes a third circuit having a second evaporator associated with the receiver such that a third refrigerant with the second evaporator is in a heat exchange relationship with the second refrigerant within the receiver.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
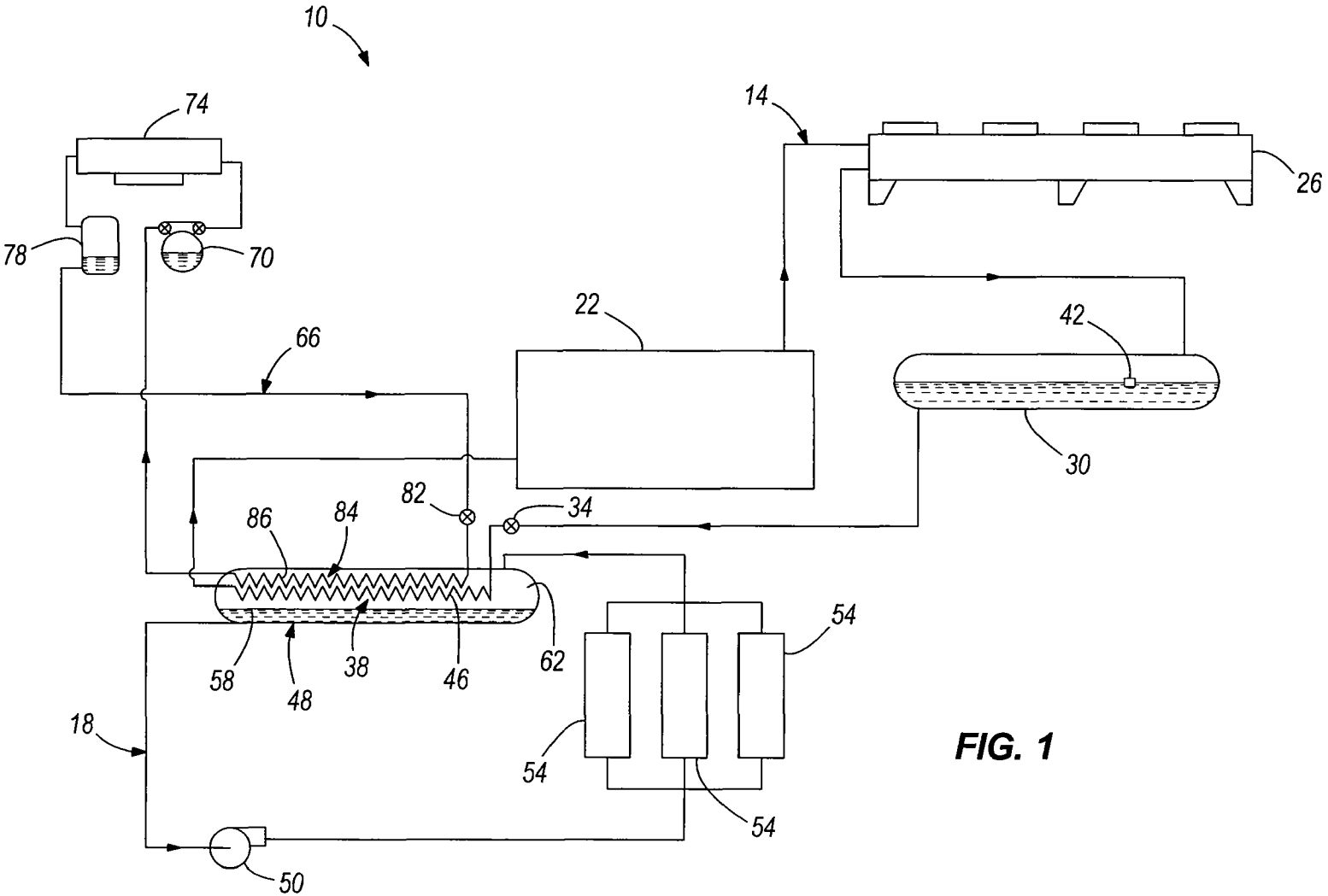
FIG. 1 is a schematic of a refrigeration system according to one embodiment of the invention.

FIG. 1 illustrates a refrigeration system 10 including a primary refrigeration circuit 14 and a secondary refrigeration circuit 18. In the illustrated embodiment, the refrigerant system 10 is used in a commercial setting (e.g., a grocery store) to keep food product at a suitable refrigerated or freezing temperature. However, it should be readily apparent to one skilled in the art that the refrigerant system 10 may be adapted or configured for use in other smaller applications (e.g., personal refrigerators, air-conditioning systems, etc.), as well as larger industrial applications (e.g., oil refineries, chemical plants, metal refineries, etc.), where refrigeration is desired or required.

The primary circuit 14 operates as a reverse-Rankine vapor compression refrigeration cycle and includes a compressor system 22, a primary condenser 26, a primary refrigerant receiver 30, an expansion device 34, and a primary evaporator 38. The primary circuit 14 circulates a refrigerant (i.e., a first refrigerant) to remove heat from a secondary fluid. In the illustrated embodiment, the primary circuit 14 is associated with the secondary circuit 18 such that the refrigerant in the primary circuit 14 removes heat from a refrigerant (i.e., a second refrigerant) in the secondary circuit 18. The first refrigerant may be, for example, refrigerant 404a.

The compressor system 22 may include a single compressor or multiple compressors arranged in parallel or in series to compress a vaporous refrigerant. The compressor(s) may be, for example, a centrifugal compressor, a rotary screw compressor, a reciprocating compressor, or the like. In the illustrated embodiment, the compressor system 22 compresses the refrigerant and delivers the compressed refrigerant to the primary condenser 26.

The primary condenser 26 is positioned downstream of the compressor system 22 to receive the vaporous, compressed refrigerant from the compressor system 22. The condenser 26 may be, for example, an air-cooled condenser or a water-cooled condenser. In the illustrated embodiment, the condenser 26 is remotely located (e.g., on a roof of a building) from the other components of the refrigeration system 10. The condenser 26 removes heat from the vaporous refrigerant to change the vaporous refrigerant into a liquid refrigerant and delivers the liquid refrigerant to the primary receiver 30.

The primary receiver 30 is positioned downstream of the condenser 26 to receive the liquid refrigerant from the condenser 26. The receiver 30 is configured to store or retain a supply of liquid refrigerant. As shown in FIG. 1, a portion of the refrigerant within the receiver 30 may also be vaporous. The refrigerant enters the receiver 30 through a top of the receiver 30 and exits the receiver 30 through a bottom of the receiver 30 to ensure only the liquid refrigerant leaves the receiver 30. In some embodiments, such as the illustrated embodiment, the receiver 30 can include a float sensor 42 to detect and monitor the liquid refrigerant level within the receiver 30.

The expansion device 34 is positioned downstream of the receiver 30 to receive the liquid refrigerant from the receiver 30. The expansion device 34 may be any suitable type of throttle valve that is operable to abruptly decrease the pressure of the liquid refrigerant. As the liquid refrigerant decreases in pressure, all or a portion of the refrigerant vaporizes and, thereby, decreases in temperature. The cool refrigerant exiting the expansion device 34 is directed toward the primary evaporator 38.

The primary evaporator 38 is positioned downstream of the expansion device 34 to receive the cool refrigerant. The evaporator 38 includes an evaporator coil 46 configured to facilitate heat exchange between the first refrigerant and the second refrigerant. In the illustrated embodiment, the evaporator coil 46 is positioned within a secondary receiver 48 of the secondary circuit 18 such that the first refrigerant removes heat from the second refrigerant. The first refrigerant warms in the evaporator 38 and is circulated back toward the compressor system 22.

The secondary circuit 18 includes the secondary receiver 48, a pump 50, and display cases 54. The secondary circuit 18 circulates the second refrigerant to remove heat from the surrounding environment. In the illustrated embodiment, the second refrigerant removes heat from air within the display cases 54; however, in other applications, the second refrigerant may remove heat from other fluids and/or structures. The second refrigerant may be, for example, carbon dioxide.

The secondary receiver 48 stores or retains a supply of liquid refrigerant 58 circulating through the secondary circuit 18. As shown in FIG. 1, a portion of the refrigerant may also be vaporous. In the illustrated embodiment, the receiver 48 is combined with the primary evaporator 38 into a single, integral unit or structure by passing the primary evaporator coil 46 through a tank of the secondary receiver 48. In such a configuration, the secondary receiver 48 is also considered a heat exchanger for the secondary circuit 18, thereby eliminating the need, in some embodiments, for a separate heat exchanger in addition to a secondary receiver.

Figure 2:
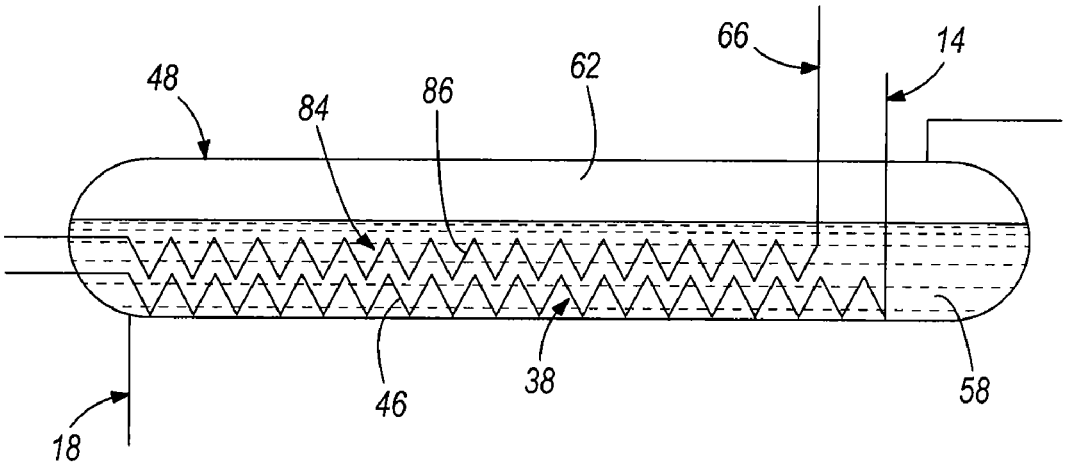
FIG. 2 is a schematic of an integral heat exchanger and receiver for use with the refrigeration system shown in FIG. 1.

In the embodiment shown in FIG. 1, the evaporator coils 46 are positioned above the liquid second refrigerant 58. In such an arrangement, vaporous second refrigerant 62 within the receiver 48 is cooled to reach a liquid state. In the embodiment shown in FIG. 2, the evaporator coils 46 are positioned in contact with the liquid second refrigerant 58. In such an arrangement, the liquid second refrigerant 58 is cooled to likewise cool and liquefy the adjacent vaporous refrigerant 62. In other embodiments, the evaporator coil 46 may be positioned partially above and partially in contact with the liquid second refrigerant 58, or the evaporator coil 46 may alternate between being above and being in contact with the liquid refrigerant 58.

The pump 50 is positioned downstream of the receiver 48 to draw the liquid refrigerant 58 from the receiver 48. The pump 50 may be any positive displacement pump, centrifugal pump, or the like suitable to move and circulate a liquid. In the illustrated embodiment, the pump 50 draws the cool, liquid refrigerant 58 from the receiver 48 and directs the refrigerant toward the display cases 54.

The display cases 54, or refrigerated merchandisers, are positioned downstream from the pump 50 to receive the cool refrigerant. The display cases 54 include heat exchangers to facilitate heat exchange between the refrigerant and the surrounding environment (e.g., the air within the display cases 54). Removing heat from the surrounding environment allows the display cases 54 to store food product at a reduced temperature suitable for refrigerating or freezing the food product. In the illustrated embodiment, the secondary circuit 18 includes three display cases 54. However, it should be readily apparent to one skilled in the art that the secondary circuit 18 may include fewer or more display cases 54 depending on the operating capacity of the refrigeration system 10.

In some embodiments, such as the illustrated embodiment, the refrigeration system 10 includes an auxiliary refrigeration circuit 66. The auxiliary circuit 66 includes an auxiliary compressor 70, an auxiliary condenser 74, an auxiliary receiver 78, an auxiliary expansion device 82, and an auxiliary evaporator 84. The components of the auxiliary circuit 66 function and are configured in a similar manner to the corresponding components in the primary circuit 14. The auxiliary circuit 66 circulates a refrigerant (i.e., a third refrigerant) to provide supplemental or backup cooling to the second refrigerant. For example, in some embodiments, the auxiliary circuit 66 may be connected to a generator or power source to run during a failure of or a loss of power to the primary circuit 14. The third refrigerant may be, for example, refrigerant 404a.

Similar to the primary evaporator 38, the auxiliary evaporator 84 includes an evaporator coil 86 positioned within the secondary receiver 48. In the embodiment shown in FIG. 1, the auxiliary evaporator coil 86 is positioned above the liquid second refrigerant 58 to exchange heat with the vaporous second refrigerant 62. In the embodiment shown in FIG. 2, the auxiliary evaporator coil 86 is positioned in contact with the liquid second refrigerant 58 to exchange heat with the liquid second refrigerant 58. In the illustrated embodiments, the primary evaporator coil 46 and the auxiliary evaporator coil 86 are either both positioned above the liquid second refrigerant 58 or both positioned in contact with the liquid second refrigerant 58. In other embodiments, the primary evaporator coil 46 and the auxiliary evaporator coil 86 may be arranged such that one coil is positioned above the liquid second refrigerant 58 and the other coil is positioned below the liquid second refrigerant 58.

In operation, the vaporous first refrigerant is compressed in the compressor system 22, condensed to a liquid at the primary condenser 26, and temporarily stored within the primary receiver 30. The liquid refrigerant is drawn from the primary receiver 30 through the expansion device 34 to rapidly reduce in pressure and cool, and passed through the evaporator coil 46 of the primary evaporator 38. As the first refrigerant passes through the evaporator 38, the first refrigerant removes heat from the second refrigerant stored in the receiver 48. The first refrigerant is then circulated back toward the compressor system 22.

The cool, liquid second refrigerant 58 is drawn from the receiver 48 by the pump 50 and directed toward the display cases 54. In the display cases 54, the second refrigerant removes heat from the surrounding environment, reducing the temperature to a suitable level for food storage. As such, the second refrigerant warms and partially or fully vaporizes in the display cases 54. The warm refrigerant is then directed back toward the receiver 48 for cooling and temporary storage.

In arrangements where the refrigeration system 10 includes the auxiliary circuit 66, the auxiliary circuit 66 is powered or turned on in response to the primary circuit 14 failing or losing power. In such a scenario, vaporous third refrigerant is compressed in the auxiliary compressor 70, condensed to a liquid in the auxiliary condenser 74, and temporarily stored within the auxiliary receiver 78. The liquid third refrigerant is drawn from the auxiliary receiver 78 through the auxiliary expansion device 82 to rapidly reduce in pressure and cool, and passed through the auxiliary evaporator coil 86 of the evaporator 84. As the third refrigerant passes through the evaporator 84, the third refrigerant removes heat from the second refrigerant stored in the receiver 48. Additionally or alternatively, the third refrigerant may remove heat from the first refrigerant passing through the primary evaporator coil 46. The third refrigerant is then circulated back toward the auxiliary compressor 70.

The refrigeration system 10 described above simplifies construction by reducing the overall number of parts or components required and reducing the number of braze joints required. As such, the labor time required to assemble the refrigeration system 10 is likewise reduced. In addition, the refrigeration system 10 decreases the refrigerant charge or volume required to be circulated through each refrigeration circuit.

Various features and advantages of the invention are set forth in the following claims.

What is claimed is:

1. A refrigeration system comprising:

a first circuit configured to circulate a first refrigerant, the first circuit including a first evaporator;

a second circuit configured to circulate a second refrigerant, the second circuit including a receiver, at least one display case, and a pump positioned downstream of the receiver to draw liquid refrigerant from the receiver, the receiver associated with the first evaporator such that the second refrigerant within the receiver is in a heat exchange relationship with the first refrigerant within the first evaporator; and a third circuit configured to circulate a third refrigerant, the third circuit including a second evaporator associated with the receiver of the second circuit and the first evaporator of the first circuit, and the third refrigerant within the second evaporator in a heat exchange relationship with the second refrigerant within the receiver.

2. The refrigeration system of claim 1, wherein the first circuit includes a compressor, a condenser, and a receiver.

3. The refrigeration system of claim 1, wherein the first refrigerant is R-404a.

4. The refrigeration system of claim 1, wherein the second refrigerant is carbon dioxide.

5. The refrigeration system of claim 1, wherein at least a portion of the second refrigerant within the receiver is a liquid, and wherein the first refrigerant passes through the first evaporator that is at least partially disposed above the liquid.

6. The refrigeration system of claim 1, wherein at least a portion of the second refrigerant within the receiver is a liquid, and wherein the first refrigerant passes through the first evaporator that is at least partially disposed in contact with the liquid.

7. The refrigeration system of claim 1, wherein the third circuit includes a compressor, a condenser, and a receiver.

8. The refrigeration system of claim 1, wherein at least a portion of the second refrigerant within the receiver is a liquid, and wherein the third refrigerant passes through the second evaporator that is at least partially disposed above the liquid.

9. The refrigeration system of claim 1, wherein at least a portion of the second refrigerant within the receiver is a liquid, and wherein the third refrigerant passes through the second evaporator that is at least partially disposed in contact with the liquid.

10. The refrigeration system of claim 1, wherein the third circuit is in operation when the first circuit is not in operation.

11. A method of exchanging heat between a first refrigerant, a second refrigerant, and a third refrigerant, the method comprising:

circulating the first refrigerant through a first circuit having a first evaporator;

circulating the second refrigerant through a second circuit having a receiver associated with the first evaporator, at least one display case, and a pump positioned downstream of the receiver;

drawing liquid refrigerant from the receiver using the pump;

exchanging heat between the first refrigerant within the evaporator and the second refrigerant within the receiver;

circulating the third refrigerant through a third circuit having a second evaporator; and exchanging heat between the third refrigerant within the second evaporator and the second refrigerant within the receiver.

12. The method of claim 11, wherein circulating the first refrigerant includes circulating the first refrigerant through a compressor, a condenser, and a receiver.

13. The method of claim 11, wherein at least a portion of the second refrigerant within the receiver is a liquid, and further comprising passing the first refrigerant through the first evaporator at least partially disposed above the liquid.

14. The method of claim 11, wherein at least a portion of the second refrigerant within the receiver is a liquid, and further comprising passing the first refrigerant through the first evaporator at least partially disposed in contact with the liquid.

15. The method of claim 11, wherein at least a portion of the second refrigerant within the receiver is a liquid, and further comprising passing the third refrigerant through the second evaporator at least partially disposed above the liquid.

16. The method of claim 11, wherein at least a portion of the second refrigerant within the receiver is a liquid, and further comprising passing the third refrigerant through the second evaporator at least partially disposed in contact with the liquid.

17. A refrigeration system comprising:

a first circuit having a first evaporator;

a second circuit having a receiver, at least one display case, and a pump positioned downstream of the receiver to draw liquid refrigerant from the receiver, a first refrigerant within the first evaporator being in a heat exchange relationship with a second refrigerant within the receiver; and a third circuit having a second evaporator associated with the receiver such that a third refrigerant within the second evaporator is in a heat exchange relationship with the second refrigerant within the receiver.

18. The refrigeration system of claim 17, wherein at least a portion of the second refrigerant within the receiver is a liquid, and wherein the first refrigerant passes through the first evaporator that is at least partially disposed above the liquid.

19. The refrigeration system of claim 17, wherein at least a portion of the second refrigerant within the receiver is a liquid, and wherein the first refrigerant passes through the first evaporator that is at least partially disposed in contact with the liquid.

20. The refrigeration system of claim 17, wherein at least a portion of the second refrigerant within the receiver is a liquid, and wherein the third refrigerant passes through the second evaporator that is at least partially disposed above the liquid.

21. The refrigeration system of claim 17, wherein at least a portion of the second refrigerant within the receiver is a liquid, and wherein the third refrigerant passes through the second evaporator that is at least partially disposed in contact with the liquid.

22. The refrigeration system of claim 17, wherein the third circuit is in operation when the first circuit is not in operation.

* * * * *